United States Patent [19]

Smith, Jr. et al.

[11] Patent Number: 5,077,471

[45] Date of Patent: Dec. 31, 1991

[54] METHOD AND APPARATUS FOR MEASURING HORIZONTAL FLUID FLOW IN DOWNHOLE FORMATIONS USING INJECTED RADIOACTIVE TRACER MONITORING

[75] Inventors: Harry D. Smith, Jr.; Larry L. Gadeken, both of Houston; Dan M. Arnold, Katy, all of Tex.

[73] Assignee: Halliburton Logging Services, Inc., Houston, Tex.

[21] Appl. No.: 580,419

[22] Filed: Sep. 10, 1990

[51] Int. Cl.[5] ..... G01V 5/00

[52] U.S. Cl. ..... 250/260; 250/269; 250/259

[58] Field of Search ..... 250/260, 259, 265, 266, 250/269, 268

[56] References Cited

U.S. PATENT DOCUMENTS

| | | | |
|---|---|---|---|
| 4,051,368 | 9/1977 | Arnold et al. | 250/270 |
| 4,085,798 | 4/1978 | Schweitzer | 250/260 |
| 4,151,413 | 4/1979 | Arnold | 250/270 |
| 4,233,508 | 11/1980 | Arnold | 250/266 |

*Primary Examiner*—Carolyn E. Fields
*Assistant Examiner*—James Beyer
*Attorney, Agent, or Firm*—William J. Beard

[57] ABSTRACT

Formation fluid flows in earth formations (37) opposite a perforated (40) wellbore (15) zone are measured and monitored by injecting radioactive tracers (50) into the perforations (40), blocking the perforations to retain the tracers (50) in the formation (37), monitoring the apparent decay rates (58) of the injected tracers (50), and then determining the rate at which the tracers are being carrier away by fluid movements in the formation (37). From this the flow rate (60) of the fluids in the earth formations (37) adjacent the borehole interval is inferred.

29 Claims, 4 Drawing Sheets

METHOD AND APPARATUS FOR MEASURING HORIZONTAL FLUID FLOW IN DOWNHOLE FORMATIONS USING INJECTED RADIOACTIVE TRACER MONITORING

BACKGROUND OF THE INVENTION

The present invention relates to oil well logging, and more particularly to methods and apparatus for measuring and monitoring horizontal formation fluid flow using radioactivity well logging techniques.

In the secondary and tertiary enhanced recovery of oil, many techniques employ the injection of water or chemical solutions into the reservoir formations. To flood the reservoir effectively, horizontal continuity must exist between injection and production wells, and good vertical conformance of the injected fluids must be maintained.

Intervals which have been inferred to be correlative from log data may in fact be separated from one well to the next by reduced permeability. This can be caused, for example, by natural factors such as formation lensing, or horizontal partitioning by permeability barriers such as shale or faults. Reduced permeability can also be caused by factors resulting from production operations, such as migrating fines, swelling clays, emulsion blocking, scale and paraffin deposition, and sand production.

Conversely, situations can arise where a zone may carry away excessive injection fluids. Such thief zones can be caused by channeling into adjacent beds or by fractures in the reservoir, and the resulting losses can be very costly.

When planning the injection of water or costly chemicals into a recovery pattern, it is thus important to identify and determine the magnitude of any such problems well in advance. Radioactive injection surveys, well-to-well pressure testing, and chemical tracer surveys can provide useful data. These techniques are somewhat qualitative in layered reservoirs and, in the case of tracer surveys, can require several weeks to obtain definitive results.

In such secondary and tertiary oil field operations it is thus often desirable—even necessary—to measure specifically the horizontal flow of injection fluids in selected zones of a downhole formation reservoir. Not only is this information useful in determining whether correlative zones in different wells (e.g., an injector and a producer) are in communication, but the nature of the communication and the relative flow rates can be determined as well.

Measuring horizontal water flow in the past has primarily utilized the injection of a tracer in one well and its subsequent detection in a nearby producer well. As suggested above, this is very time consuming since it requires the tracer to move physically between the wells. It is also expensive since continual monitoring or sample testing is required. Further, if the tracer should move (e.g., through a fault or channel) into some other zone, it might never be detected.

One previously known and described technique eliminates some of these problems in unperforated monitor wells in areas having saline waters. (See U.S. Pat. No. 4,051,368, Arnold et al., issued Sept. 27, 1977; and "Logging Method for Determining Horizontal Velocity of Water in Oilfield Formations" by H. D. Scott and H. J. Paap, and D. M. Arnold, *Journal of Petroleum Technology*, April, 1980, pp. 675-684). In this technology, a neutron source is used to generate in-situ a 15 hour half-life $Na^{24}$ tracer in the formation of interest. A spectral gamma detector is then moved opposite the activated zone and the rate of $Na^{24}$ decay is measured. If an apparent non-exponential decay rate faster than the theoretical 15 hour half-life is observed, then the faster-than-expected decay is attributed to movement of the tracer away from the wellbore due to water movement. The rate of water flow can be determined from the actual shape of the decay curve—the faster the flow the more rapid and non-exponential is the $Na^{24}$ apparent decay. This technique has several advantages over prior techniques: it is much faster, and it actually samples the fluid flow in the well of interest. Unfortunately, it also has several limitations which in some environments are not significant, but in others can be troublesome. Some of these are:

(1) Only a limited number of depth points can be measured in a well in a reasonable time. That is, the source must be accurately placed for 2 hours activation, and the detector then accurately placed to monitor the decay for several more hours. All of these steps must be performed for each individual water flow data point.

(2) The observation well cannot be perforated.

(3) The technique is restricted to saline waters-the fresher the water (and hence the less sodium in the fluid), the lower the reliability of the technique.

(4) Flow rates only in a limited velocity range can be detected. Very fast flow rates are not suitable for monitoring within a 15 hours half-life isotope; very slow flow rates are not suitable either.

(5) There are many interfering half-lives from other downhole elements activated by the source, and these cause difficulty in interpreting the data. The most important is the 2.5 hour half-life from activated iron in the casing. These interfering elements can also restrict the flow rates which it is possible to measure.

A need therefore remains for formation fluid flow measuring methods and apparatus which can make such measurements in reasonable periods of time, in perforated wells, independently of the properties of the particular formation fluid of interest, over a wide range of formation fluid flow rates, without interference from extraneous radioactivity emissions; and which are inexpensive, uncomplicated, highly versatile, reliable, and readily suited to the widest possible utilization in formation fluid flow measuring and monitoring.

SUMMARY OF THE INVENTION

Briefly, the present invention meets the above needs and purposes with new and improved methods and apparatus for measuring and monitoring horizontal formation fluid flow. As taught by the present invention, one or more radioactive tracers are injected into the perforations in the well interval of interest. The perforations are then blocked to retain the tracers in the formation and prevent backflow of the tracers into the borehole. Next, the radioactive decays of the injected tracers are monitored and their apparent decay rates in the adjacent formations are determined. Using the same techniques taught by the prior activation methods discussed above, it is then possible to determine how quickly the tracers are apparently being flushed or carried away by fluid movements in the formation. From this the flow rate of the fluids moving in the earth formations past the perforated interval is inferred.

Among the advantages of the present invention, to be discussed further herein, is the ability to select tracers with half-lives appropriate to the particular fluid flow rates at hand, rather than being restricted primarily to $Na^{24}$. Also, large intervals in the well can be monitored in reasonable time periods, since the long activation periods required by the prior art technique are not required.

It is therefore a feature of the present invention to provide new and improved methods and apparatus for determining the flow rate in earth formations of fluids moving past a perforated interval in a well borehole; such methods and apparatus in which at least one predetermined radioactive of interest in the borehole; in which the perforations in the interval are subsequently blocked to prevent backflow of the tracers into the borehole; in which the decays of the injected tracers are monitored, and from the monitored decays the apparent decay rates of the injected radioactive tracers are determined; in which the flow rate of the fluids moving in the earth formations past the perforated interval is then determined from the determined apparent decay rates; in which a base gamma spectral log may be taken in perforated interval prior to injecting the radioactive tracers; in which, from the monitored decays, post-injection gamma spectral logs may be generated; in which such a base gamma spectral log may be subtracted from such post-injection gamma spectral logs to assist in determining the apparent decay rates of the radioactive tracers; in which, from the determined flow rate, a log of flow rate versus depth for the earth formation fluids may be generated; in which a plurality of such tracers may be injected having different isotopes tagged to corresponding different materials in the formation; in which the perforations in the interval may be blocked only temporarily; in which any backflow of isotopes into the borehole may be monitored by determining the respective decay rates of any such isotopes in the borehole fluid; in which such backflow monitoring may be done by measuring the borehole fluid isotope decay rates outside the zone of the perforated interval; in which the several steps just enumerated may be repeated over at least one more perforated interval to determine such flow rates over multiple intervals; and to accomplish the above features and purposes in an inexpensive, uncomplicated, versatile, and reliable method and apparatus, inexpensive to implement, and readily suited to the widest possible utilization in formation fluid flow measuring and monitoring.

These and other features and advantages of the invention will be apparent from the following description, the accompanying drawings, and the appended claims.

DESCRIPTION OF THE PREFERRED EMBODIMENTS

Figure 1:
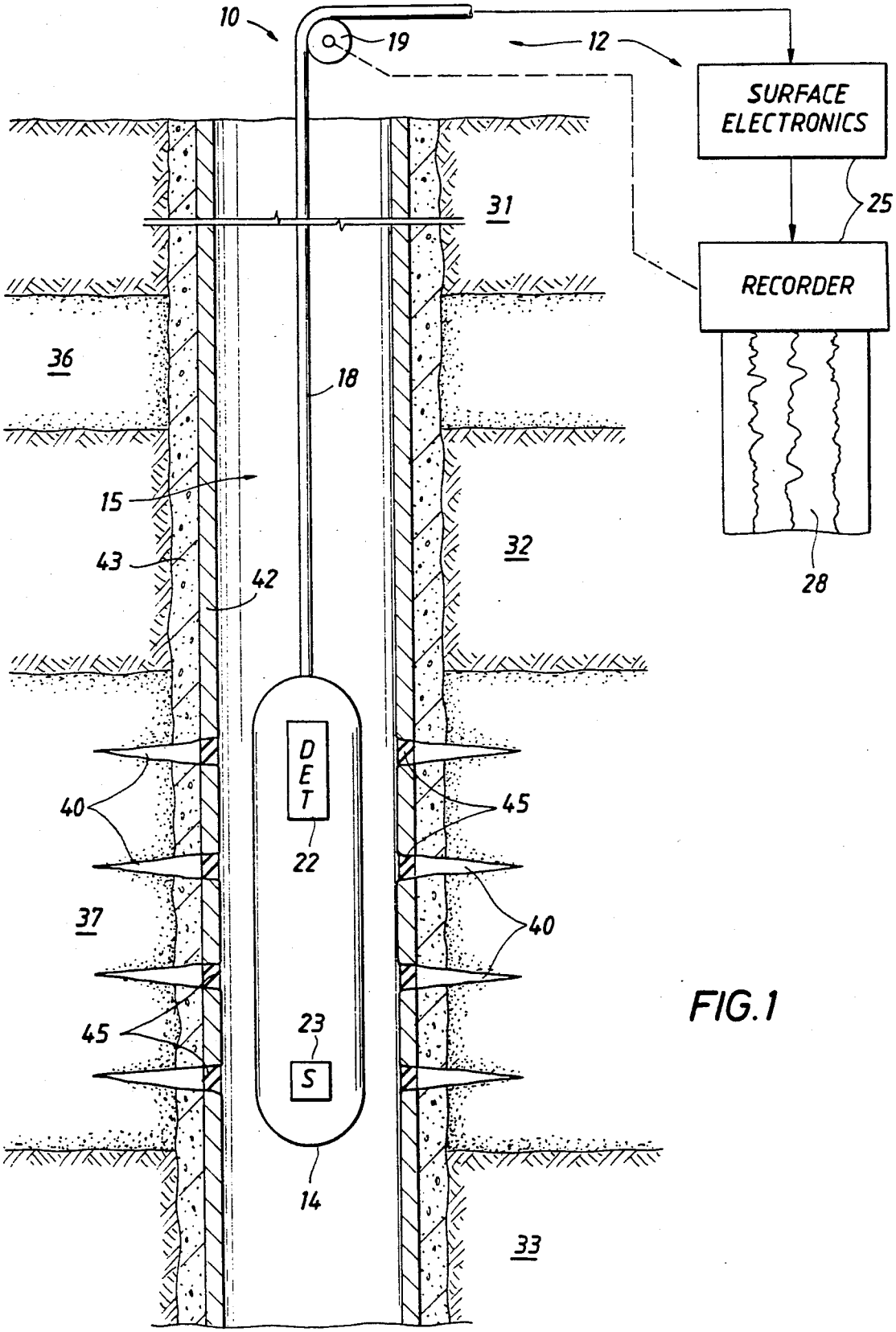
FIG. 1 is a figurative illustration showing a preferred embodiment of the present invention in which the well logging sonde thereof is positioned in a perforated borehole interval for measuring the flow rate of fluids in the adjacent earth formations.

With reference to the drawings, the new and improved methods and apparatus for measuring and monitoring horizontal formation fluid flow according to the present invention will now be described. Referring to FIG. 1, a preferred embodiment 10 of the present invention is shown positioned for measuring the flow rate of fluids in the earth formations adjacent a perforated borehole interval.

More particularly, the invention includes surface equipment 12 and a downhole sonde portion 14. Sonde 14 is supported in a cased borehole 15 by a conventional logging cable 18, both of which are raised and lowered within borehole 15 in known fashion by a winch 19 located in the surface equipment 12. Cable 18 connects downhole electronics 22 and gamma ray detector 23 with surface electronics and recording system 25, in equipment 12, for making downhole gamma spectral measurements, processing those measurements, and generating a log 28 of the resulting formation fluid flow measurements. Except for the particular descriptions given further herein, such equipment and processing methods are known in the art and do not need to be further described.

Borehole 15 is shown traversing many formations, including impermeable formations 31, 32, and 33, and permeable formations 36 and 37. The borehole interval opposite formation 37 has been perforated by perforations 40, penetrating the casing 42 and cement 43 into formation 37. Finally, the drawing shows the perforations blocked by a blocking agent 45, as further described below.

Figure 3:
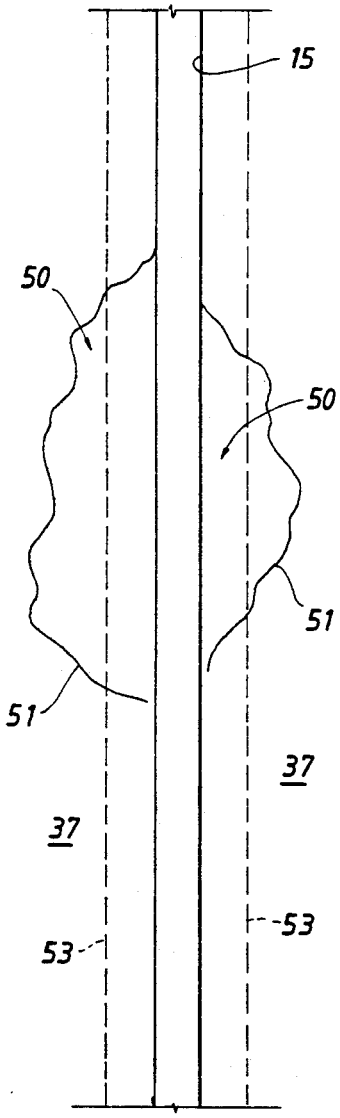
FIG. 3 is a schematic illustration figuratively demonstrating the initial distribution of the injected radioactive tracers in the formations adjacent the borehole.

As taught by the present invention, the prior art problems with the $Na^{24}$ in-situ tracer and other problems of prior flow detection methods are reduced or eliminated, as follows. In a preferred embodiment of the present invention, a base gamma spectral log (not shown) is first run in well 15 across the interval, such as perforated formation 37, where it is desired to measure horizontal formation water flow. This background log is not required if subsequent tracer concentrations are adequate to yield tracer count rates high enough such that the background is inconsequential in the data analysis procedure. Then one or more radioactive tracers 50 (FIG. 3) are injected into the perforations 40 (before blocking agent 45 has been applied). FIG. 3 illustrates the initial distribution 51 of the injected radioactive tracers in formation 37, and the relationship thereof with the effective depth of investigation 53 of sonde 14. If only one tracer is employed, the base gamma log could be a gross gamma ray log instead of a spectral gamma ray log.

Figure 2:
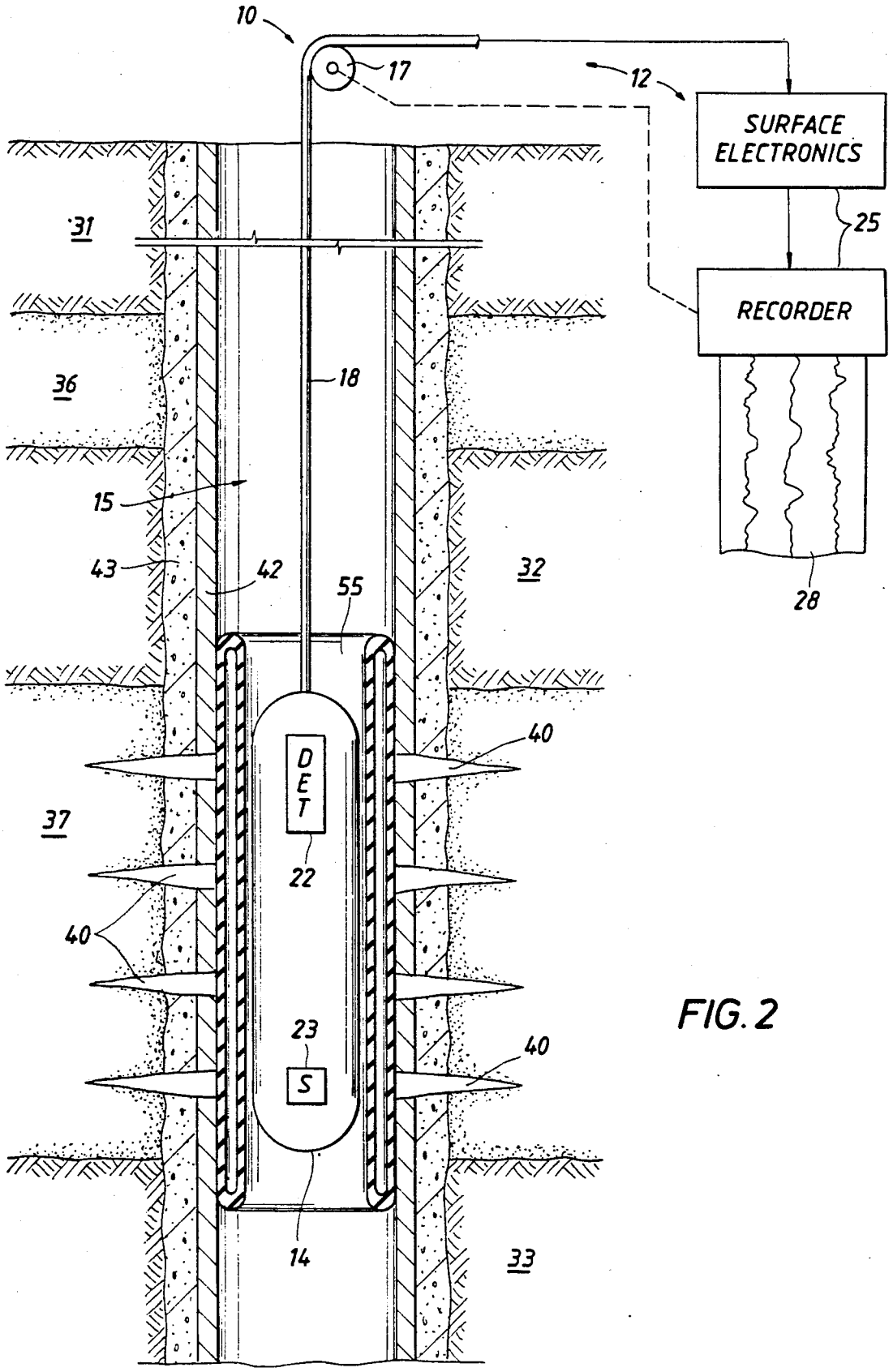
FIG. 2 is an illustration similar to FIG. 1 showing another embodiment of the present invention.

Next, the perforations are suitably blocked by plugs 45 to prevent backflow of the radioactive tracers 50 into the borehole 15. Blocking agent 45 is preferably a temporary plug to provide for restoring communication between the borehole and the formation following the measurement. Alternatively, an expanded packer or bladder 55, as shown in FIG. 2, may be used to temporarily seal off the perforations 40.

After the tracer(s) are injected and the perforations plugged, follow-up logs are recorded with the logging tool 10, at time intervals consistent with monitoring the decay(s) of the specific tracer isotope(s) injected. The natural background spectra (the base gamma spectral log) are then subtracted from the post-injection spectra, and the resulting spectra are deconvolved if more than one tracer has been employed into the components from the various isotopes present. If only one tracer has been used, the deconvolution step is not required. The decay rate(s) of the isotope(s) are then observed as a function of depth and time at selected points or in selected logging intervals. (FIG. 4), and flow rates are computed using methods similar to those described in the '368 patent and the Scott et al article (above). This computational process is repeated from each of the fixed depths or throughout the selected logged intervals, so that a continuous or a point by point log of flow rate versus depth for each isotope is generated.

Figure 4:
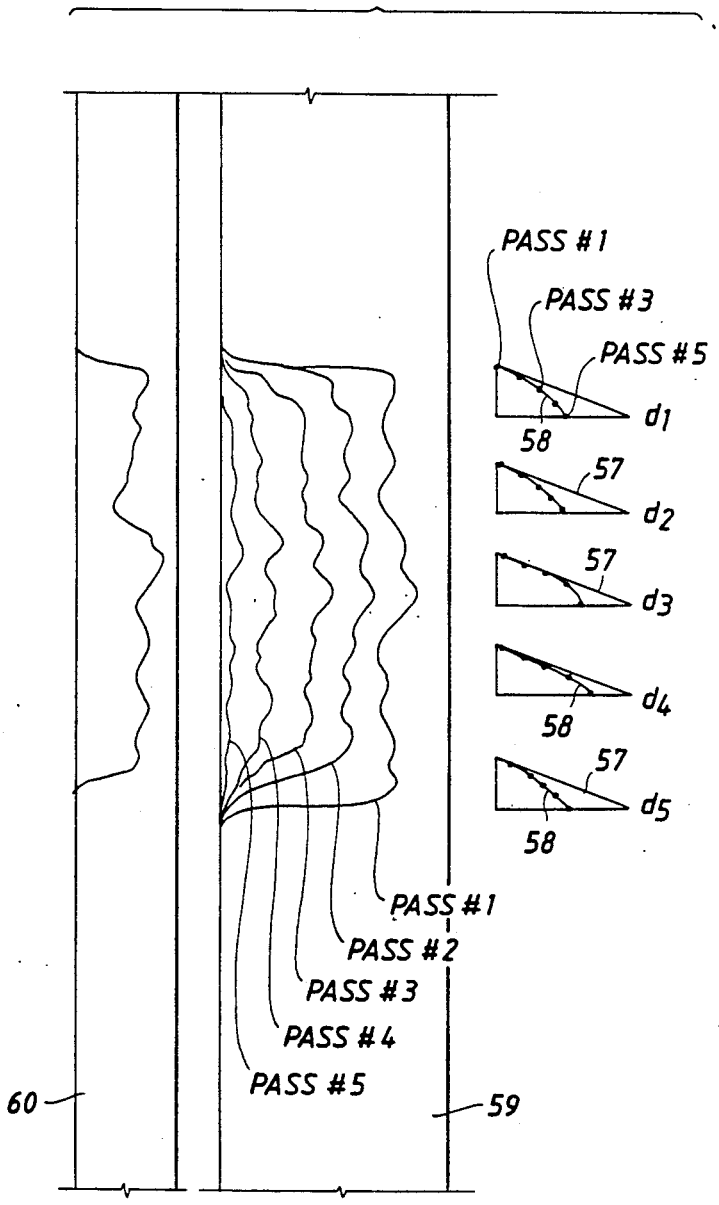
FIG. 4 is a graphical representation illustrating measured count rates on successive passes of the sonde through the borehole interval, deviations of the measured count rates from expected decay count rates, and the resulting computed formation fluid flow rates.

FIG. 4 illustrates this process. Reading from right to left, the successive count rates (on a log/linear scale) for passes 1 through 5 are shown for five representative depths $d_1$–$d_5$. The straight lines 57 above the actual counts show the decay curves which would have obtained had the radioactive tracers remained in situ at those locations. The actual curves 58 trace through the count rate points for the passes. In the middle of FIG. 4 is a log 59 of the count rates obtained for the successive continuous logging passes through the interval. On the left side of FIG. 4 is a log 60 of the computed fluid velocities versus depth based upon the time dependent count rate data obtained from the five passes. As indicated above, this last portion of the analysis is taught in the prior art, and its implementation should therefore be apparent to those skilled in the art.

Figure 5:
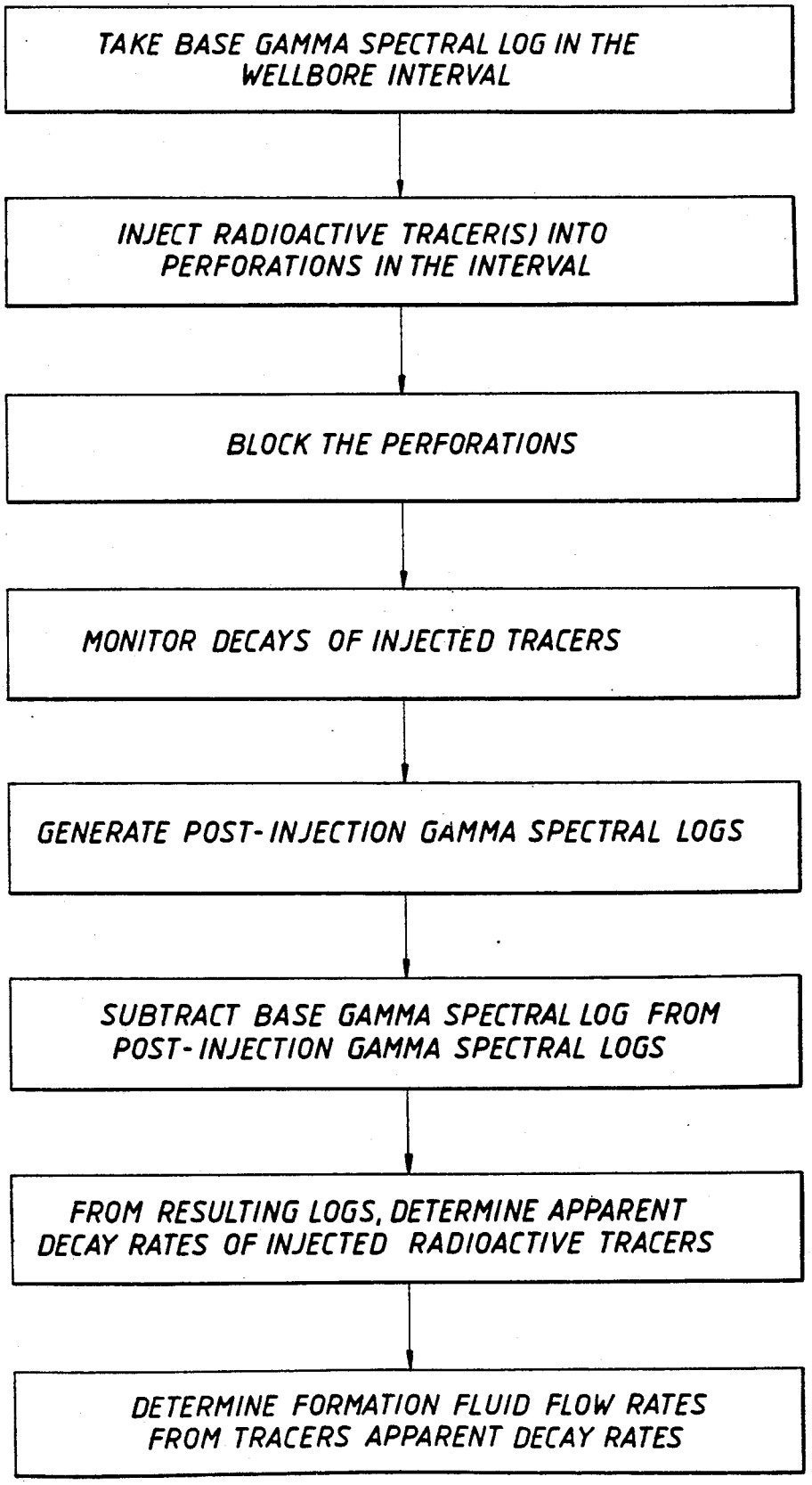
FIG. 5 is a flow chart showing the sequence of steps in performing the present invention.

Finally, FIG. 5 shows the sequence of steps in performing a preferred embodiment of the present invention.

As may be seen, therefore, the present invention provides numerous advantages over prior art techniques, such as the $Na^{24}$ flow measurement technique. For example:

(1) It can be used in perforated wells—in fact, it is designed for use in such wells.

(2) The entire zone of interest can be monitored, not just a few specific points in the borehole.

(3) There are no interfering decays for in situ, non-moving neutron activated materials, such as iron in the casing.

(4) A wide range of flow velocities can be measured using multiple tracer isotopes with different half-lives. Rapidly decaying tracers will provide the needed data in zones where flow rates are fast; long half-life tracers will provide the needed data in zones where flow is very slow; intermediate decay rate tracers will optimally cover the mid-flow rate range. If flow rates are unknown or variable over the interval of interest, then multiple tracers with a range of half lives can be used. After the spectral deconvolution, the appropriate decay can be monitored in each zone.

(5) Upward or downward, as well as horizontal, flow can be detected. Non-exponential tracer decay due to vertical migration can be identified as a source or error in horizontal water flow calculations, thus improving overall accuracy.

(6) Different isotopes can be tagged to different injection fluids or solids, indicating the relative flow rates of different fluids or materials in the formation. For example, oil could be tagged with one tracer, water with another, and the relative downhole horizontal flow rates of oil and water could then be determined.

(7) The spectral count rate data can be processed and deconvolved to give the strength of each individual tracer. The decay rates for each tracer can then be analyzed separately without having to separate the decay rates from the other injected tracers.

Of course, various modifications to the present invention will occur to those skilled in the art upon reading the present disclosure. For example, other means besides blocking agent 45 or bladder 55 may be used to close the perforations. A cement squeeze operation, or a mechanical sliding sleeve, could also be used. In some wells, isolation could be provided by placing packers above and below the formation (i.e., the logging could then be done through-tubing with a small diameter logging tool).

Backflow into the borehole (such as might occur if one of the perforation seals 45 or 55 failed) could be monitored above and below the zones of interest by looking at the count rate in the borehole and the decay rate of any residual isotopes in the borehole fluid. Non-exponential borehole decay at a lower-than-expected rate could imply a tracer leak into the borehole from the formation. Of course, a leak into the borehole from the formation would cause the observed formation decay rate to indicate an erroneously high horizontal water flow rate. Monitoring the absence of backflow above and below the perforations would add a confidence factor to the calculated formation flow rates. If after the fracture job the borehole had been initially cleared of all radioactive tracer material, it would then only be necessary to observe a count rate increase in the borehole outside the zone of tracer injection, relative to the natural gamma activity, to indicate a tracer leak into the wellbore. Unexpected borehole gamma activity within the zone of interest itself could also be observed using techniques such as taught in U.S. Pat. No. 4,625,111 (Smith, Jr., issued Nov. 25, 1986, and assigned to the assignee of the present invention) to separate the borehole and formation signals from each other.

Finally, it is located that the measurement of horizontal water flow using the $Na^{24}$ neutron activation technique works because the radial distance to which the borehole and formation materials are activated by the neutrons matched fairly closely the investigation depth of the tool used to measure the gamma rays emitted by the decaying nuclei. It will be clear that the injection program used to place the radioactive tracer(s) should accordingly be matched to the sonde and formation characteristics. In particular, the radial depth to which the tracer(s) are injected should not significantly exceed the depth of investigation of the gamma tool. Otherwise, since the present invention is based upon detecting a net flow of radioactive material away from the gamma detector, an initial tracer distribution out to a distance significantly beyond the depth of investigation of the gamma tool could result in an exponential decay of the net flux reaching the detector, even with horizontal flow, depending on the flow rate, until the tracer(s) have decayed away.

Therefore, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A method for determining the flow rate in earth formations of fluids moving in the vicinity of a perforated interval in a well borehole, comprising:

(a) injecting at least one predetermined radioactive tracer into the perforations in the interval, (b) blocking the perforations in the interval to prevent backflow of the at least one injected tracer into the borehole, (c) monitoring the decays of said at least one injected tracer as a function of time and depth, (d) from the monitored decays, determining as a function of depth the apparent decay rate of said at least one injected radioactive tracer, and (e) from the determined apparent decay rate, determining the flow rate of the fluids moving in the earth formations past the perforated interval.

2. The method of claim 1 and further comprising:

(f) taking a base gamma spectral log in the perforated interval prior to said injecting step, (g) from the monitored decay, generating a post-injection gamma spectral log, and (h) subtracting said base gamma spectra log from said post-injection gamma spectral log to assist in determining said apparent decay rate.

3. The method of claim 1 further comprising, from said determined flow rate generating a log of flow rate versus depth for the earth formation fluids.

4. The method of claim 1 further comprising injecting a plurality of radioactive tracers having different isotopes with different half lives tagged to corresponding different materials in the formation.

5. The method of claim 4 wherein the plurality of tracers are spectrally deconvolved or separated prior to the computation of flow rates of each of the individual tracers.

6. The method of claim 1 wherein a plurality of tracers having different half lives are injected in order to assist in determining flow rates which span a range of velocities across the interval of interest.

7. The method of claim 1 wherein said blocking step further comprises temporarily blocking the perforations in the interval.

8. The method of claim 1 further comprising monitoring any backflow of isotopes into the borehole by determining the respective decay rates of any such isotopes in the borehole fluid.

9. The method of claim 8 wherein said backflow monitoring is done by measuring the borehole fluid isotope decay rates outside the zone of the perforated interval.

10. The method of claim 1 further comprising repeating steps (a) through (e) over at least one or more perforated interval to determine said flow rate over multiple intervals.

11. A method for determining the flow rates in earth formations of fluids moving in the vicinity of a perforated interval in a well borehole, comprising:

(a) taking a base gamma spectral log in the interval, (b) injecting at least one predetermined radioactive tracer into the perforations in the interval, (c) temporarily blocking the perforations in the interval to prevent backflow of said at least one injected radioactive tracer into the borehole, (d) from within the borehole and at predetermined time intervals, monitoring the decay of said at least one injected tracer as a function of depth to generate plural time dependent post-injection gamma spectral logs, (e) subtracting said base gamma spectral logs as a function of depth from said post-injection time and depth dependent gamma spectral logs, (f) from the spectral logs resulting from said subtracting step, determining the apparent decay rates of each of said at least one injected radioactive tracer as a function of depth, (g) from said apparent decay rates, determining the flow rates of fluids moving in the earth formations past the perforated interval as a function of depth, and (h) generating a log of the determined flow rates versus depth for the earth formation fluids and (i) repeating the preceding steps over at least one more perforated intervals to determine such flow rates of multiple intervals.

12. The method of claim 11 further comprising monitoring any backflow of isotopes into the borehole by determining the respective decay rates of any such isotopes in the borehole fluid.

13. The method of claim 11 further comprising injecting a plurality of radioactive tracers having different isotopes tagged to corresponding different materials in the formation.

14. The method of claim 11 wherein plural radioactive tracers are used and each of said tracers are spectrally deconvolved or separated prior to the computation of flow rates of each of the individual tracers comprising said plural radioactive tracers which are used.

15. The method of claim 11 wherein a plurality of tracers having different half lives are injected in order to assist in determining flow rates which span a range of velocities across the interval of interest.

16. Apparatus for determining the flow rate in earth formations of fluids moving past a perforated interval in a well borehole, comprising:

means for injecting at least one predetermined radioactive tracer into the perforations in the interval, means for blocking the perforations in the interval to prevent backflow of said at least one radioactive injected tracer into the borehole, monitoring and determining means for monitoring the decay of said at least one injected tracer as a function of depth and determining the apparent decay rate thereof, means connected to said monitoring and determining means for determining the flow rate of fluids moving in the earth formations past the perforated interval as a function of depth and means utilizing said determined flow rate to generate a log of flow rate versus depth for the earth formation fluids.

17. The apparatus of claim 16 further comprising:

(a) means for taking a base gamma spectral log in the perforated interval prior to the injection of said at least one injected radioactive tracer, and (b) means connected to said monitoring and determining means for generating at least one post-injection gamma spectral log.

18. The apparatus of claim 17 further comprising:

(a) means also connected to said monitoring and determining means for subtracting said base gamma spectral log from said at least one post-injection gamma spectral log to assist in determining said apparent decay rate.

19. The apparatus of claim 16 further comprising means for injecting a plurality of radioactive tracers having different isotopes tagged to corresponding different materials in the formation.

20. The apparatus of claim 19 further comprising means for spectrally deconvolving or separating the spectra of each of said plurality of tracers prior to the computation of the flow rates of each of said tracers.

21. The apparatus of claim 20 further comprising means for injecting a plurality of tracers having different half lives to assist in determining flow rates which span a range of velocities across the interval of interest.

22. The apparatus of claim 16 wherein said means for blocking further comprises means for temporarily blocking the perforations in the interval.

23. The apparatus of claim 16 further comprising means for monitoring any backflow of isotopes into the borehole by determining the respective decay rates of any such isotopes in the borehole fluid.

24. The apparatus of claim 23 wherein said backflow monitoring means further comprises means for measuring the borehole fluid isotope decay rates outside the zone of the perforated interval.

25. Apparatus for determining the flow rates in earth formations of fluids moving horizontally past a perforated interval in a well borehole, comprising:

(a) means for taking a base gamma spectral log across the interval, (b) means for injecting at least one predetermined radioactive tracer into the perforations in the interval, (c) means for temporarily blocking the perforations in the interval to prevent backflow of said at least one radioactive tracer into the borehole, (d) means within the borehole for monitoring the decay of said at least one injected tracer as a function of depth at predetermined time intervals to generate post-injection gamma spectra logs, (e) means connected to said means for monitoring said apparent decay rate for determining the flow rates of the fluids moving in the earth formations past the perforated interval, (f) means for generating a log of the determined flow rates versus depth for the earth formation fluids and (g) means for monitoring any backflow of injected isotopes into the borehole by determining the respective decay rates of any such isotopes in the borehole fluid.

26. The apparatus of claim 25 further including:

(h) means for subtracting said base gamma spectra log from said post-injection gamma spectral log, (i) means connected to said means for subtracting for determining the apparent decay rate of said at least one injected tracer.

27. The apparatus of claim 25 further comprising means for injecting a plurality of said tracers having different isotopes tagged to corresponding different materials in the formation.

28. The apparatus of claim 27 further including means of spectrally deconvolving or separating the spectra of said plurality of tracers prior to the computation of the flow rates of each of said tracers.

29. The apparatus of claim 28 further including means for injecting a plurality of tracers having different half lives to assist in determining flow rates which span a range of velocities across the interval of interest.

* * * * *